US006911053B1

(12) United States Patent
Bijsterbosch et al.

(10) Patent No.: US 6,911,053 B1
(45) **Date of Patent: *Jun. 28, 2005**

(54) TREATMENT FOR FABRICS

(75) Inventors: Henri Derk Bijsterbosch, Wirral (GB); Deborah Jane Cooke, Wirral (GB); Peter Neil Jones, Wirral (GB)

(73) Assignee: Unilever Home & Personal Care USA, a division of Conopco, Inc., Greenwich, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/869,928

(22) PCT Filed: Dec. 6, 1999

(86) PCT No.: PCT/EP99/09590

§ 371 (c)(1),
(2), (4) Date: Aug. 24, 2001

(87) PCT Pub. No.: WO00/40684

PCT Pub. Date: Jul. 13, 2000

(30) Foreign Application Priority Data

Jan. 5, 1999 (GB) ..... 9900150

(51) Int. Cl.[7] ..... C11D 3/37; C11D 3/22; D06L 1/00

(52) U.S. Cl. ..... 8/137; 510/470; 510/473; 510/474; 510/475; 510/535

(58) Field of Search ..... 510/470, 473, 510/474, 475, 535; 8/137

(56) References Cited

U.S. PATENT DOCUMENTS

| | | | | |
|---|---|---|---|---|
| 2,553,485 | A | 5/1951 | Swanson | |
| 3,480,511 | A | 11/1969 | Jones | |
| 4,179,382 | A | 12/1979 | Rudkin et al. | |
| 4,661,267 | A | 4/1987 | Dekker et al. | |
| 5,064,555 | A | 11/1991 | Medcalf, Jr. et al. | |
| 6,248,710 | B1 * | 6/2001 | Bijsterbosch et al. | 510/470 |
| 6,288,022 | B1 * | 9/2001 | Clark et al. | 510/470 |
| 6,358,903 | B2 * | 3/2002 | Hopkinson et al. | 510/375 |
| 6,384,011 | B1 * | 5/2002 | Leupin et al. | 510/473 |
| 6,455,489 | B2 * | 9/2002 | Bijsterbosch et al. | 510/471 |
| 6,475,980 | B2 * | 11/2002 | Bijsterbosch et al. | 510/473 |
| 6,506,220 | B2 * | 1/2003 | Clark et al. | 8/115.51 |
| 6,517,588 | B2 * | 2/2003 | Hopkinson | 8/137 |
| 6,562,771 | B2 * | 5/2003 | Finch et al. | 510/101 |
| 2003/0119708 | A1 * | 6/2003 | Hunter et al. | 510/466 |
| 2003/0130159 | A1 * | 7/2003 | Hopkinson et al. | 510/475 |
| 2003/0162688 | A1 * | 8/2003 | Findlay et al. | 510/515 |

FOREIGN PATENT DOCUMENTS

| | | |
|---|---|---|
| DE | 29 25 859 A1 | 1/1981 |
| DE | 35 31 756 A1 | 3/1986 |
| EP | 0227321 | 11/1986 |
| EP | 0367335 | 10/1989 |
| GB | 834375 | 5/1960 |
| GB | 1042438 | 9/1966 |
| GB | 1565006 | 4/1980 |
| GB | 2039556 A | 8/1980 |
| GB | 2314840 A | 1/1998 |
| WO | 91/09106 | 6/1991 |
| WO | 93/15116 | 8/1993 |

OTHER PUBLICATIONS

*Detergency: Theory and Technology,* (1987 no month given) Surfactant Science Series; V. 20, edited by W. Gale Cutter and Erik Kissa, p. 285.
Article Enzymatic Degradation of Tamarind Kernel Powder, Indian Journal of Technology, vol. 8, Sep. 1970, H. C. Srivastava, S. N. Harshe & G. P. Mudia, pp. 347–349.
Derwent Abstract XP 002133480 PN RD172011A—1 page.
Derwent Abstract XP 002133481 PN JP51020203—1 page.
Derwent Abstract XP 002133482 PN DK9801395—1 page.
GB Search Report GB 99001505 Apr. 22, 1999—3 pages.
PCT Search Report PCT/EP 9909590 Mar. 31, 2000—2 pages.

* cited by examiner

*Primary Examiner*—Brian P. Mruk
(74) *Attorney, Agent, or Firm*—Alan A. Bornstein

(57) ABSTRACT

A method of conferring one or more benefits during the laundering of textile fabrics is disclosed. The method includes contacting the fabric with a modified naturally occurring polysaccharide gum having β1-4 linkages, and a weight average molecular weight of 250,000 or less.

6 Claims, No Drawings

TREATMENT FOR FABRICS

TECHNICAL FIELD

The present invention relates to an oligomeric or polymeric material for deposition onto a fabric to endow a visible fabric care benefit to the fabric.

BACKGROUND OF THE INVENTION

It is known to use polysaccharide gums having $\beta_{1-4}$ linkage (hereinafter referred to as β-1,4-polysaccharides) as ingredients in detergent compositions, e.g. guar gum when used as a thickener in bleach compositions and liquid fabric washing compositions, and as additives to detergent powders e.g. to improve the structural and/or free-flowing properties of the powders.

It is also known to use various different materials in laundry products for color care, e.g. to reduce the fading of coloured dyes in the fabric due to repeated washes.

It is has now been found by the applicants that surprisingly, $\beta_{1-4}$ polysaccharides also are useful in detergent products for fabric care benefits such as colour care performance, as well as anti-pilling. Unfortunately, at levels required for this purpose, the applicants have noticed a negative in terms of enhanced staining with particulate stains on the fabric.

This problem has now been overcome by modifying the naturally occurring polysaccharides that their weight average molar weight is 250,000 or less.

Techniques for reducing the molecular weight of naturally occurring polysaccharides are well known in the art.

Degradation of galactomannans, polyuronic acids and galactans by a thermal process in an oxygen-free atmosphere is described in GB-A-1 042 438.

Galactomannans for anti-gelling of food products, by peroxide or acid hydrolysis is disclosed in GB-A-1 565 006.

GB-A-834 375 describes a method for retarding the degradation of galactomannans in hot aqueous systems by inclusion of certain water-soluble metal salts.

According to U.S. Pat. No. 2,553,485, manno-galactans can be heat degraded to modify their adhesive properties.

The acid hydrolysis of partially hydrated carbohydrate gums at elevated temperatures is the subject of WO 93/15116.

Proteolytic degradation of tamarind seed kernel polysaccharide is described in U.S. Pat. No. 3,480,511 and Ind. J. Technology, Vol. 8, September 1970, H. C. Srivastava et al, pp 347–349.

Another non-laundry use of low molecular polysaccharide is disclosed in GB-A-2 314 840. According to this teaching, polysaccharides having a molecular weight of between 1,000 and 50,000 are useful for wound dressings oR peptide/protein binding.

As far as use of low molecular polysaccharides in surfactant-based products is concerned, EP-A-367 335 discloses use of a cationic guargum having a molecular weight of 50,000–100,000,000 preferably 100,000–500,000, especially 250,000–400.000 to improve the feel of toilet bars based on alkali metal soaps. According to EP-A-227 321, the mildness of soap bars is improved using a hydrated cationic polymeric polysaccharide having from 5–6 saccharide units on average. Another soap bar containing a cationic polysaccharide having a molecular weight of 1,000–3,000,000, preferably 2,500–350,000 is disclosed in U.S. Pat. No. 5,064,555.

U.S. Pat. No. 4,179,382 discloses a textile softening agent which includes a cationic salt which optionally may be a cationic polysaccharide, e.g. having a molecular weight of 220,000.

However, none of the aforementioned reference discloses a modified low molecular weight naturally occurring polysaccharide as useful for conferring care benefits in fabric treatment products, e.g. for use in the wash and/or rinse.

Research Disclosure 172011 discloses the use of modified gum. JP-A-51020203 discloses the use of a gum modified by the addition of hydroxy-alkyl ether groups. These are both anti-redeposition agents intended to hold soil in solution and prevent it being re-deposited onto fabric.

US-A4661267 discloses a cationic modified material as does DE-A-2925869, GB-A-2039556, DE-A-3531756 and U.S. Pat. No. 4,179,382. These are substantive materials and all appear to have some kind of softening benefit.

WO-A-9109106 relates to a toilet bar for skin cleaning. This illustrates that short chain guar gums am known to exist, but says nothing about their potential for use in the manner specified in the present claims.

DK 9801395 discloses a method of 'biopolishng' fabric that gives a protective effect against fibre damage if used in a finishing process. The polymers are said to have an anti-reduction effect if used in a laundering process. For the finishing effect materials are used in an undisguised form and treated with enzyme only after application to the cloth.

DEFINITION OF THE INVENTION

The present invention provides a method for reducing visible surface damage to fabric during laundering which comprises the step of treating the fabric with a neutral modified naturally occurring polysaccharide gum having $\beta_{1-4}$ linkages, the modified polysaccharide having a weight average molecular weight of 250,000 or less, preferably 100,000 or less, more preferably 75,000 or less, to confer a benefit to a textile fabric during laundering thereof.

DETAILED DESCRIPTION OF THE INVENTION

Preferably, the weight average molecular weight of the modified polysaccharide is 100,000 or less, more preferably 75,000 or less.

The molecular weight of the naturally occurring polysaccharide may be reduced by a number of different means, for example by enzymatic cleavage, using an appropriate enzyme such as a cellulase, or marmanase, or by acid hydrolysis, or any other method known in the art. The enzymatic degradation of xyloglucan is disclosed in U.S. Pat. No. 3,480,511. Preferred cellulases include those sold under Trade Marks Celluzyme, Endolase, Carezyme and Puradax.

Typical polysaccharide gums which may be used modified, in detergent compositions or other treatment products, include galactomannan (e.g. derived from locust bean gum or guar gum), glucomannan (e.g. Konjac glucomannan) xanthan gum and xyloglucan (e.g. tamarind xyloglucan), and mixtures thereof.

Preferably, the polysaccharide is uncharged or is anionic.

Compositions

The polysaccharide may be incorporated into compositions containing only a diluent (which may comprise solid and/or liquid) and/or also comprising an active ingredient.

The polysaccharide is typically included in said compositions at levels of from 0.01% to 25% by weight, preferably from 0.1% to 20%, e.g. from 0.5% to 20%, most preferably from 0.2% to 5%. Another preferred range is from 1% to 15%.

The active ingredient in the compositions is preferably a surface active agent or a fabric conditioning agent. More than one active ingredient may be included. For some applications a mixture of active ingredients may be used.

The compositions of the invention may be in any physical form e.g. a solid such as a powder or granules, a tablet, a solid bar, a paste, gel or liquid, especially, an aqueous based liquid.

The compositions of the present invention are laundry compositions, especially main wash (fabric washing compositions or rinse-added softening compositions. The main wash compositions may include a fabric softening agent and rinse-added fabric softening compositions may include surface active compounds, particularly non-ionic surface-active compounds, if appropriate.

The detergent compositions of the invention may contain a surface-active compound (surfactant) which may be chosen from soap and non soap anionic, cationic, non-ionic, amphoteric and zwitterionic surface active compounds and mixtures thereof. Many suitable surface-active compounds are available and are fully described in the literature, for example, in "Surface-Active Agents and Detergents", Volumes I and II, by Schwartz, Perry and Berch.

The preferred detergent active compounds that can be used are soaps and synthetic non-soap anionic and non-ionic compounds.

The compositions of the invention may contain linear alkylbenzene sulphonate, particularly linear alkylbenzene sulphonates having an alkyl chain length of $C_8$–$C_{15}$. It is preferred if the level of linear alkylbenzene sulphonate is from 0 wt % to 30 wt %, more preferably 1 wt % to 25 wt %, most preferably from 2 wt % to 15 wt %.

The compositions of the invention may contain other anionic surfactants in amounts additional to the percentages quoted above. Suitable anionic surfactants are well-known to those skilled in the art. Examples include primary and secondary alkyl sulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

The compositions of the invention may also contain non-ionic surfactant Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

It is preferred if the level of non-ionic surfactant is from 0 wt % to 30 wt %, preferably from 1 wt % to 25 wt %, most preferably from 2 wt % to 15 wt %.

It is also possible to include certain mono-alkyl cationic surfactants which can be used in main-wash compositions for fabrics. Cationic surfactants that may be used include quaternary ammonium salts of the general formula $R_1R_2R_3R_4N^+X^-$ wherein the R groups are long or short hydrocarbon chains, typically alkyl, hydroxyalkyl or ethoxylated alkyl groups, and X is a counter-ion (for example, compounds in which $R_1$ is a $C_8$–$C_{22}$ alkyl group, preferably a $C_8$–$C_{10}$ or $C_{12}$–$C_{14}$ alkyl group, $R_2$ is a methyl group, and $R_3$ and $R_4$, which may be the same or different, are methyl or hydroxyethyl groups); and cationic esters (for example, choline esters).

The choice of surface-active compound (surfactant), and the amount present, will depend on the intended use of the detergent composition. In fabric washing compositions, different surfactant systems may be chosen, as is well known to the skilled formulator, for handwashing products and for products intended for use in different types of washing machine.

The total amount of surfactant present will also depend on the intended end use and may be as high as 60 wt %, for example, in a composition for washing fabrics by hand. In compositions for machine washing of fabrics, an amount of from 5 to 40 wt % is generally appropriate. Typically the compositions will comprise at least 2 wt % surfactant e.g. 2–60%, preferably 15–40% most preferably 25–35%.

Detergent compositions suitable for use in most automatic fabric washing machines generally contain anionic non-soap surfactant, or non-ionic surfactant, or combinations of the two in any suitable ratio, optionally together with soap.

The compositions of the invention, when used as main wash fabric washing compositions, will generally also contain one or more detergency builders. The total amount of detergency builder in the compositions will typically range from 5 to 80 wt %, preferably from 10 to 60 wt/o.

Inorganic builders that may be present include sodium carbonate, if desired in combination with a crystallisation seed for calcium carbonate, as disclosed in GB 1 437 950 (Unilever); crystalline and amorphous aluminosilicates, for example, zeolites as disclosed in GB 1 473 201 (Henkel), amorphous aluminosilicates as disclosed in GB 1 473 202 (Henkel) and mixed crystalline/amorphous aluminosilicates as disclosed in GB 1 470 250 (Procter & Gamble); and layered silicates as disclosed in EP 164 514B (Hoechst). Inorganic phosphate builders, for example, sodium orthophosphate, pyrophosphate and tripolyphosphate are also suitable for use with this invention.

The compositions of the invention preferably contain an alkali metal, preferably sodium, aluminosilicate builder. Sodium aluminosilicates may generally be incorporated in amounts of from 10 to 70% by weight (anhydrous basis), preferably from 25 to 50 wt %.

The alkali metal aluminosilicate may be either crystalline or amorphous or mixtures thereof, having the general formula: 0.8–1.5 $Na_2O$. $Al_2O_3$. 0.8–6 $SiO_2$.

These materials contain some bound water and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature. Suitable crystalline sodium aluminosilicate ion-exchange detergency builders are described, for example, in GB 1 429 143 (Procter & Gamble). The preferred sodium aluminosilicates of this type are the well-known commercially available zeolites A and X, and mixtures thereof.

The zeolite may be the commercially available zeolite 4A now widely used in laundry detergent powders. However, according to a preferred embodiment of the invention, the zeolite builder incorporated in the compositions of the invention is maximum aluminium zeolite P (zeolite MAP) as described and claimed in EP 384 070A (Unilever). Zeolite MAP is defined as an alkali metal aluminosilicate of the zeolite P type having a silicon to aluminium ratio not exceeding 1.33, preferably within the range of from 0.90 to 1.33, and more preferably within the range of from 0.90 to 1.20.

Especially preferred is zeolite MAP having a silicon to aluminium ratio not exceeding 1.07, more preferably about 1.00. The calcium binding capacity of zeolite MAP is generally at least 150 mg CaO per g of anhydrous material.

Organic builders that may be present include polycarboxylate polymers such as polyacrylates, acrylic/maleic copolymers, and acrylic phosphonates; monomeric polycarboxylates such as citrates, gluconates, oxydisuccinates, glycerol mono-, di and trisuccinates, carboxymethyloxy succinates, carboxymethyloxymalonates, dipicolinates, hydroxyethyliminodiacetates, alkyl- and alkenylmalonates and succinates; and sulphonated fatty acid salts. This list is not intended to be exhaustive.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt/o, preferably from 1 to 10 wt %.

Builders, both inorganic and organic, are preferably present in alkali metal salt, especially sodium salt, form.

Compositions according to the invention may also suitably contain a bleach system. Fabric washing compositions may desirably contain peroxy bleach compounds, for example, inorganic persalts or organic peroxyacids, capable of yielding hydrogen peroxide in aqueous solution.

Suitable peroxy bleach compounds include organic peroxides such as urea peroxide, and inorganic persalts such as the alkali metal perborates, percarbonates, perphosphates, persilicates and persulphates. Preferred inorganic persalts are sodium perborate monohydrate and tetrahydrate, and sodium percarbonate.

Especially preferred is sodium percarbonate having a protective coating against destabilisation by moisture. Sodium percarbonate having a protective coating comprising sodium metaborate and sodium silicate is disclosed in GB 2 123 044B (Kao).

The peroxy bleach compound is suitably present in an amount of from 0.1 to 35 wt %, preferably from 0.5 to 25 wt %. The peroxy bleach compound may be used in conjunction with a bleach activator (bleach precursor) to improve bleaching action at low wash temperatures. The bleach precursor is suitably present in an amount of from 0.1 to 8 wt %, preferably from 0.5 to 5 wt %.

Preferred bleach precursors are peroxycarboxylic acid precursors, more especially peracetic acid precursors and pernoanoic acid precursors. Especially preferred bleach precursors suitable for use in the present invention are N,N,N',N',-tetracetyl ethylenediamine (TAED) and sodium noanoyloxybenzene sulphonate (SNOBS). The novel quaternary ammonium and phosphonium bleach precursors disclosed in U.S. Pat. No. 4,751,015 and U.S. Pat. No. 4,818,426 (Lever Brothers Company) and EP 402 971A (Unilever), and the cationic bleach precursors disclosed in EP 284 292A and EP 303 520A (Kao) are also of interest.

The bleach system can be either supplemented with or replaced by a peroxyacid, examples of such peracids can be found in U.S. Pat. No. 4,686,063 and U.S. Pat. No. 5,397,501 (Unilever). A preferred example is the imido peroxycarboxylic class of peracids described in EP A 325 288, EP A 349 940, DE 382 3172 and EP 325 289. A particularly preferred example is phtalimido peroxy caproic acid (PAP). Such peracids are suitably present at 0.1–12%, preferably 0.5–10%.

A bleach stabiliser (transition metal sequestrant) may also be present. Suitable bleach stabilisers include ethylenediamine tetra-acetate (EDTA), the polyphosphonates such as Dequest (Trade Mark) and non-phosphate stabilisers such as EDDS (ethylene diamine di-succinic acid). These bleach stabilisers are also useful for stain removal especially in products containing low levels of bleaching species or no bleaching species.

An especially preferred bleach system comprises a peroxy bleach compound (preferably sodium percarbonate optionally together with a bleach activator), and a transition metal bleach catalyst as described and claimed in EP 458 397A, EP 458 398A and EP 509 787A (Unilever).

The compositions according to the invention may also contain one or more enzyme(s). Suitable enzymes include the proteases, amylases, cellulases, oxidases, peroxidases and lipases usable for incorporation in detergent compositions. Preferred proteolytic enzymes (proteases) are, catalytically active protein materials which degrade or alter protein types of stains when present as in fabric stains in a hydrolysis reaction. They may be of any suitable origin, such as vegetable, animal, bacterial or yeast origin.

Proteolytic enzymes or proteases of various qualities and origins and having activity in various pH ranges of from 4–12 are available and can be used in the instant invention. Examples of suitable proteolytic enzymes are the subtilins which are obtained from particular strains of *B. Subtilis B. licheniformis*, such as the commercially available subtilisins Maxatase (Trade Mark), as supplied by Gist Brocades N. V., Delft, Holland, and Alcalase (Trade Mark), as supplied by Novo Industri A/S, Copenhagen, Denmark.

Particularly suitable is a protease obtained from a strain of *Bacillus* having maximum activity throughout the pH range of 8–12, being commercially available, e.g. from Novo Industri A/S under the registered trade-names Esperase (Trade Mark) and Savinase (Trade-Mark). The preparation of these and analogous enzymes is described in GB 1 243 785. Other commercial proteases are Kazusase (Trade Mark obtainable from Showa-Denko of Japan), Optimase (Trade Mark from Miles Kali-Chemie, Hannover, West Germany), and Superase (Trade Mark obtainable from Pfizer of U.S.).

Detergency enzymes are commonly employed in granular form in amounts of from about 0.1 to about 3.0 wt %. However, any suitable physical form of enzyme may be used.

The compositions of the invention may contain alkali metal, preferably sodium carbonate, in order to increase detergency and ease processing. Sodium carbonate may suitably be present in amounts ranging from 1 to 60 wt %, preferably from 2 to 40 wt %. However, compositions containing little or no sodium carbonate are also within the scope of the invention.

Powder flow may be improved by the incorporation of a small amount of a powder structurant, for example, a fatty acid (or fatty acid soap), a sugar, an acrylate or acrylate/maleate copolymer, or sodium silicate. One preferred powder structurant is fatty acid soap, suitably present in an amount of from 1 to 5 wt %.

Other materials that may be present in detergent compositions of the invention include sodium silicate; antiredeposition agents such as cellulosic polymers; soil release polymers; inorganic salts such as sodium sulphate; lather control agents or lather boosters as appropriate; proteolytic and lipolytic enzymes; dyes; coloured speckles; perfumes; foam controllers; fluorescers and decoupling polymers. This list is not intended to be exhaustive. However, many of these ingredients will be better delivered as benefit agent groups in materials according to the first aspect of the invention.

The detergent composition when diluted in the wash liquor (during a typical wash cycle) will typically give a pH of the wash liquor from 7 to 10.5 for a main wash detergent.

Particulate detergent compositions are suitably prepared by spray-drying a slurry of compatible heat-insensitive ingredients, and then spraying on or post-dosing those ingredients unsuitable for processing via the slurry. The skilled detergent formulator will have no difficulty in deciding which ingredients should be included in the slurry and which should not.

Particulate detergent compositions of the invention preferably have a bulk density of at least 400 g/l, more preferably at least 500 g/l. Especially preferred compositions have bulk densities of at least 650 g/liter, more preferably at least 700 g/liter.

Such powders may be prepared either by post-tower densification of spray-dried powder, or by wholly non-tower methods such as dry mixing and granulation; in both cases a high-speed mixer/granulator may advantageously be used. Processes using high-speed mixer/granulators are disclosed, for example, in EP 340 013A, EP 367 339A, EP 390 251A and EP 420 317A (Unilever).

Liquid detergent compositions can be prepared by admixing the essential and optional ingredients thereof in any desired order to provide compositions containing components in the requisite concentrations. Liquid compositions according to the present invention can also be in compact form which means it will contain a lower level of water compared to a conventional liquid detergent.

Any suitable method may be used to produce the compounds of the present-invention. In particular polymerisation of the sunscreen and/or SOQ and polymer as described in the examples may be used.

Treatment

The treatment of the fabric with the material of the invention can be made by any suitable method such as washing, soaking or rinsing of the fabric.

EXAMPLE 1

Enzymatic Degradation of Xyloglucan (1) The xyloglucan solution was prepared in the following way Srivastava H. C., Harshe, S. N.; Mudia, C. P.; Ind. J. Technology; 1970, 8, 347–349.

50 g of material was slowly added to 3 liters of demineralised water under high agitation by a stirrer (from above) in a 51 glass beaker. The stirring was continued at room temperature for about 15 minutes and the temperature was raised to 40 degrees Celsius, while stirring. The solution was stirred until all of the polymer had dissolved and a 1 ml sample was taken for analysis.

0.2 g of cellulase (Clazinase liquid) were added. The solution was then firmly stirred at 40° C. for 1½ hours and then a 1 ml sample was taken. The viscosity of both the "before" and "after" samples was measured on a Carri-med CSL 100 Controlled Stress Rheometer, carefully following the instructions on the safety sheet. The temperature of the solution was raised to 80° C. to denature the enzyme and the solution was allowed to cool to room temperature and then freeze dried.

The molecular weight of the xyloglucan before and after the treatment was measured by gel permeation chromatography. The native xyloglucan has a Mw of 230.000, after the treatment it was in the order of 30.000 g/mol. The molecular weight distribution had increased considerably.

EXAMPLE 2

Acid Hydrolysis of Locust Bean Gum

The galactomannan solution are prepared in the following way: 30 gram of material was added to 3 liter of demineralised water under high agitation by a stirrer (from above) in a glass beaker. The stirring was continued at room temperature for about 15 minutes, then the stirring is stopped. The glass beaker was placed on a steam heater plate and the temperature is raised to 80 degrees Celsius, while stirring.

From a 1 M HCl solution was added enough to decrease the pH to 1.8. The solution was then firmly stirred for another 3 hours. The temperature and pH were checked regulary, keeping them constant at or adjusted to 80 degrees and 1.8, respectively. The solution was then allowed to cool down to room temperature and the pH adjusted to neutral with a solution of NaOH.

The solution was centrifuged in a Centricon 124 (Colloid Science) at 8500 rpm (10000 g) for 90 minutes using the 6×500 rota. The beakers were each weighed and adjusted to have the same mass within 0.5 g. The supernatant was decanted-off.

The supermatant (SN) was alcohol-exchanged by mixing one volume of SN with four volumes of propan-2-ol (IPA). This procedure was executed step-wise involving no more than 2 liters of IPA per step. This mixture was hand-stirred with a glass rod. The low MW-modified locust bean gum precipitated as a gelatinous material, which was removed from the liquid and retained. The gels obtained from each temperature fraction were washed three times with neat IPA. This was carried out using a Buchner funnel lined with miracloth or a fine nylon mesh.

The product was placed in acetone to purge the material of alcohol and residual water and was left to stand for 1 hour covered with foil in a fume cabinet. The acetone was exchanged for fresh solvent and stood for another hour. The acetone was exchanged once more and the gels allowed to soak overnight in the fume cabinet.

The LBG gel was seen to turn from translucent to opaque white. It was broken-up into small pieces during the acetone exchange steps. The gel fractions were drained through a Buchner funnel (with medium glass fibre filter paper) to remove free acetone. The product was vacuum dried for three days at 40° C. and subsequently stored at ambient in a dry sealed pot.

Examples 3 and 4: Detergent Formulations

| Component | Example 3 % w/w | Example 4 % w/w |
|---|---|---|
| Na-LAS | 8.68 | 10.37 |
| Nonionic 7EO, branched | 4.55 | 5.45 |
| Nonionic 3EO, branched | 2.44 | 2.92 |
| soap | 1.12 | 1.34 |
| zeolite A24 (anhydrous) | 29.63 | 35.43 |
| Na-citrate 2aq | 3.49 | 4.17 |
| light soda ash | 5.82 | 6.96 |
| SCMC (68%) | 0.54 | 0.65 |
| Antifoam granule | 1.70 | 2.20 |
| Fluorescer adjunct (15%) | 1.30 | |
| PVP (95%) | 0.10 | 0.60 |
| SRP (18%) | 1.50 | 1.50 |
| Sokalan CP5 (93%) | 1.00 | 1.00 |
| Na-citrate 2aq | — | 3.60 |
| Na-carbonate | 0.00 | 11.35 |
| Na-Bi-carbonate | 1.00 | 4.00 |
| Nabion 15 (carbonate/29% sil co-gram) | 5.5 | — |
| TAED white (as gran.83%) | 5.5 | — |
| Coated Percarbonate (13.5 avOx) | 19.00 | — |
| Dequest 2047 | 1.00 | 1.40 |

-continued

Examples 3 and 4: Detergent Formulations

| Component | Example 3 % w/w | Example 4 % w/w |
|---|---|---|
| Savinase 12.0T 3250 GU/mg | 0.78 | 0.78 |
| Lipolase 100T 187 LU/mg | 0.12 | 0.12 |
| Minors, moisture, salts | balance | balance |
| TOTAL | 100.00 | 100.00 |

In Examples 3 and 4, two batches were made, one with 3% on top of 100% of the modified product of Example 1 and the other with the same amount of the modified product of Example 2.

Raw Material Specification

| Component | Specification |
|---|---|
| Na LAS | Sodium salt, alkyl benzene sulphonate |
| Nonionic 7EO, branched | C12–C15 branched alcohol ethoxylated with an average of 7 ethyleneoxy groups |
| Nonionic 3EO, branched | C12–C15 branched alcohol ethoxylated with an average of 3 ethyleneoxy groups |
| SCMC | Sodium carboxymethyl cellulose |
| PVP | Polyvinyl pyrrolidone |
| Sokalan CP5 | Polymer builder |
| Dequest 2047 | Metal Sequestrant, ex Monanto |
| Savinase 12.0T | Proteolytic enzyme, ex Novo |
| Lipolase 100T | Lipolytic enzyme |
| Carezyme 1.0T | Cellulase enzyme |

EXAMPLE 5

Comparative Test

Fabrics

A multi wash was performed in the presence on locust bean gum. In the multiwash a whole range of different materials were used, including real garments. This made it possible to determine whether the presence of locust bean gum, in a series of main wash cycles, had any effects on the properties of various fabrics. The fabric properties studied were:

pilling (Blue cotton interlock new and prepilled)

colour fastness of the fabric (standard fabrics and a variety of bought garments, coloured cotton, knitted and woven and viscose) both printed and dyed.

microscopic fibre damage (white cotton and viscose).

Multiwash (15 Washes).

Before the multiwash, all the fabrics were measured on the spectaflash. The multiwash was carried out using two computerized front loading automatic machines (one with polymer present and a control with no polymer). Fifteen washes were carried out with no drying steps between the washes.

Control

To each of the 15 washes was added:

250 ml of 0.64M carbonate buffer 250 ml of 32 g/l (50:50 LAS/A7) surfactant solution 500 ml of demineralized water ~0.25 g of Dow Corning silicone antifoam.

Test

To each of the 15 washes was added:

250 ml of 0.64M carbonate buffer 250 ml of 32 g/l (50:50 LAS/A7) surfactant solution 500 ml of 8 g/l locust bean gum solution (~80% active)

~0.25 g of Dow Corning silicone antifoam.

Total carbonate buffer concentration was 0.01M.

Total surfactant concentration was 0.5 g/l.

Final polymer concentration was 0.20 g/l.

Ballast cotton was added to both fabric loads to make them up to 2 kg each. The machines used 16 L of water this gave a liquor to cloth ratio of 8:1. Both machines were put on a 40° C. cycle.

Three replicate sets of the fabrics were used. Two of these sets were added from the first wash. In this way the washload was kept constant throughout the experiment. After the multiwash three sets of fabrics were obtained that only differed in the number of wash cycles (5, 10 & 15). After the full 15 washes all fabrics were viewed to determine whether the locust bean gum had any effect on the properties of the cloth. All cloths were measured on the spectraflash to observe any changes in colour. Most were panelled, i.e. blue cotton interlock for pilling, and the others for general appearance and colour.

Results

Electron Microscopy

Woven cotton and viscose clothes washed in the different conditions have been studied by electron microscopy. The electron micrographs clearly showed less damage in the presence of locust bean gum compared to the control.

Effects on Coloured Fabrics

Instrumental Analysis Results

| CLOTH | WASH NUMBER | DELTA E (control) | DELTA E (test) | DIFFERENCE IN DELTA E |
|---|---|---|---|---|
| pigment prints on woven vicose (avg) | 5 | 2.62 | 2.01 | 0.61 |
| | 10 | 5.23 | 4.62 | 0.61 |
| | 15 | 6.2 | 5.04 | 1.16 |

The reflectance of the fabrics was measured before washing and after 5, 10 and 15 wash cycles. The results in the table are an average of the following six fabrics:

Imperon yellow KR+PBA

Inperon yellow KR+PB50

Imperon red KR+PBA

Imperon red KR+PB50

Imperon blue KR+PBA

Imperon blue KR+PB50.

Other dyed fabrics used in the multiwash include:

Hydron blue (15%) (ex. Hoechst) on woven cotton

*Indigo* (ex BASF) on woven cotton

Combination of vat dyes* on woven cotton

*Indian-Threne Grey S607 Coll, Green FFB Coll, and Yellow 65 Coll, all ex CIBA

These fabrics have been panelled and the preference scores (average of three) are given below.

| | 5 WASHES | 10 WASHES | 15 WASHES |
|---|---|---|---|
| LBG preferred | 23 | 20 | 20 |
| control preferred | 7 | 10 | 10 |

Pilling Effects

The preference scores, for both the new and pre-pilled blue cotton interlock are given in the table below.

| | 5 WASHES | 10 WASHES | 15 WASHES |
|---|---|---|---|
| new, LBG preferred/10 | 7 | 9 | 10 |
| pre-pilled, LBG preferred/10 | 9 | 10 | 9 |

EXAMPLE 6

Comparative Test

Conditions are the same as in example 5. Now four different test conditions have been used and were compared against a control. Locust bean gum native, acid hydrolysed locust bean gum, enzymatically hydrolysed tamarind xyloglucan and konjac gluccomannan, ten washes were performed and the fabrics were dried in the tumble dryer between every wash.

Results

A clearly visible benefit was seen on prints on knitted cotton pyjama shirts. All six panellist preferred the test fabrics (for all four test conditions) above the control.

EXAMPLE 7

Staining with Low Molecular Weight Locust Bean Gum

Conditions are the same as in example 5. White woven cotton fabrics were washed once in the different conditions (locust bean gum and hydrolysed locust bean gun and control). They were subsequently stained with clay and washed again in the same condition. The difference in reflectance of the stain before and after washing, which is a measure of the stain removal, was measured and the results are given in the table below.

| Condition | Delta R (460 nm) |
|---|---|
| Control (no gum) | 31.6 |
| Locust bean gum | 23.2 |
| hydrolysed locust bean gum | 33.3 |

What is claimed is:

1. A method of conferring a benefit to a textile fabric by contacting said fabric during laundering thereof with a modified naturally occuring polysaccharide gum having $\beta_{1-4}$ linkages, the modified polysaccharide having a weight average molecular weight of 250,000 or less; and wherein the modified polysaccharide is derived from a naturally occurring polysaccharide selected from galactomannan, glucomannan, xyloglucan, xanthan gum and mixtures thereof.

2. The method of claim 1, wherein the modified polysaccharide is neutral or anionic.

3. A detergent composition comprising surfactant and modified polysaccharide as defined in claim 1.

4. A composition according to claim 3, wherein the amount of surfactant is from 5% to 50% by weight of the composition and the amount of modified polysaccharide is from 0.01% to 25% by weight of the composition.

5. A method of conferring a benefit to a textile fabric by contacting said fabric during laundering thereof with a polysaccharide gum having $\beta_{1-4}$ linkages, to confer a benefit to a textile fabric during laundering thereof; wherein the polysaccharide is an unmodified version of a polysaccharide selected from glacatomannan, glucomannan, xyloqlucan, xantham gum and mixtures thereof.

6. A method of conferring a benefit to a textile fabric by contacting said fabric during laundering thereof with a modified naturally occuring polysaccharide gum having $\beta_{1-4}$ linkages, the modified polysaccharide having a weight average molecular weight of 75,000 or less; wherein the modified polysaccharide is derived from a naturally occurring polysaccharide selected from locust bean gum, guar gum, Konjac glucomannan, tamarind xyloglulcan, and mixtures thereof.

* * * * *